US007404363B2

(12) United States Patent
Dunstan

(10) Patent No.: US 7,404,363 B2
(45) Date of Patent: Jul. 29, 2008

(54) SECURITY DOOR AND FRAME CONSTRUCTION

(75) Inventor: Brett Dunstan, Hallam (AU)

(73) Assignee: Lokaway Pty. Ltd, Hallam, Victoria (AU)

( * ) Notice: Subject to any disclaimer, the term of this patent is extended or adjusted under 35 U.S.C. 154(b) by 32 days.

(21) Appl. No.: 10/530,467

(22) PCT Filed: Oct. 8, 2003

(86) PCT No.: PCT/AU03/01321

§ 371 (c)(1),
(2), (4) Date: Apr. 6, 2005

(87) PCT Pub. No.: WO2004/033835

PCT Pub. Date: Apr. 22, 2004

(65) Prior Publication Data

US 2006/0037519 A1 Feb. 23, 2006

(30) Foreign Application Priority Data

Oct. 9, 2002 (AU) ..... 2002951987
Apr. 30, 2003 (AU) ..... 2003902027

(51) Int. Cl.
*E06B 3/50* (2006.01)

(52) U.S. Cl. ..... 109/70; 16/239; 49/254; 109/74; 312/139.1

(58) Field of Classification Search ..... 109/70, 109/74, 69, 71–73; 49/254, 257, 258, 394; 16/242, 239; 312/139.1, 326, 329
See application file for complete search history.

(56) References Cited

U.S. PATENT DOCUMENTS

| | | | | | |
|---|---|---|---|---|---|
| 825,253 | A * | 7/1906 | Watson | 109/69 |
| 915,397 | A * | 3/1909 | Weiss | 109/70 |
| 958,624 | A * | 5/1910 | Glazier | 109/70 |
| 990,469 | A * | 4/1911 | Anderson | 109/69 |
| 1,873,522 | A | 8/1932 | Abbott et al. | |
| 2,936,206 | A | 5/1960 | Wilmer et al. | |
| 3,270,462 | A | 9/1966 | Obadal et al. | |
| 3,481,288 | A | 12/1969 | Teleky | |

(Continued)

FOREIGN PATENT DOCUMENTS

AU A-17475/88 6/1988

(Continued)

*Primary Examiner*—Lloyd A Gall
(74) *Attorney, Agent, or Firm*—D. Peter Hochberg; Sean F. Mellino; Daniel J. Smola

(57) ABSTRACT

This security door construction is applicable to safes, factory doors and house doors. An offset hinge assembly allows the door to swing open and closed and also to slide in and out of a door slot in the door frame at the closing edge of the door. In the construction of a safe, hooks on the inside of the door enter slots in upstands inside the safe and engage and disengage through the sliding motion. House doors and screen doors use a hinge assembly which operates in the same way as the safe. One pair of hinges are fixed to the frame and the second pair of hinges are fixed to the door. The frame and door pairs are connected by a rod or tube which ensures that the hinge axis of the door pair remains parallel to the hinge axis of the frame pair. A door locking mechanism is actuated by a conventional pneumatic door closer. A gas strut supplies the thrust to cause the mechanism to slide the door into the door slot when the door closer brings the door into register with the door slot.

11 Claims, 15 Drawing Sheets

U.S. PATENT DOCUMENTS

| | | | | | |
|---|---|---|---|---|---|
| 3,788,689 | A | * | 1/1974 | Lloyd | 292/304 |
| 4,070,074 | A | * | 1/1978 | Rohme | 312/245 |
| 4,262,447 | A | | 4/1981 | Schneier et al. | |
| 4,294,040 | A | | 10/1981 | Crotti | |
| 4,367,684 | A | | 1/1983 | Jucker | |
| 4,548,330 | A | * | 10/1985 | Hewitt et al. | 220/210 |
| 4,679,353 | A | * | 7/1987 | Langenbach et al. | 49/257 |
| 4,704,970 | A | | 11/1987 | Sanderson et al. | |
| 4,712,490 | A | | 12/1987 | Lichter | |
| 4,852,503 | A | | 8/1989 | Lichter | |
| 4,932,160 | A | | 6/1990 | Sperko | |
| 5,056,262 | A | * | 10/1991 | Schweiss et al. | 49/56 |
| 5,931,104 | A | | 8/1999 | Horn et al. | |
| 5,953,860 | A | * | 9/1999 | Morgan et al. | 49/257 |
| 5,971,515 | A | | 10/1999 | Baker et al. | |

FOREIGN PATENT DOCUMENTS

| | | | |
|---|---|---|---|
| AU | A-11342/95 | | 8/1995 |
| AU | 2000 12438 | A1 | 7/2000 |
| CA | 2 325 318 | | 5/2002 |
| EP | 0145079 | | 6/1985 |
| EP | 0607040 | B1 | 9/1997 |
| FR | 928207 | | 11/1947 |
| FR | 2456198 | | 12/1980 |
| WO | WO 96/29496 | | 9/1996 |
| WO | WO 99/50519 | | 10/1999 |
| WO | WO 00/79084 | A1 | 12/2000 |
| WO | WO 01/71140 | A1 | 9/2001 |
| WO | WO 02/059528 | A1 | 8/2002 |
| WO | WO 02/101185 | A1 | 12/2002 |

* cited by examiner

SECURITY DOOR AND FRAME CONSTRUCTION

This application is a National Stage application of International Application No. PCT/AU2003/001321, filed on Oct. 8, 2003, which claims priority of Australian Application Serial No. 2002951987 filed on Oct. 9, 2002 and Australian Application Serial No. 2003902027 filed on Apr. 30, 2003.

BACKGROUND OF THE INVENTION

Field of the Invention

This invention concerns security door and frame construction and relates to safes.

Provision for security in doors include measures such as making the door and frame resistant to attack, providing special locks and adding multiple bolts which shoot into the frame. Such measures are effective in their own way and intruders devise counter measures as new security equipment becomes available.

EP 0665 356 A1 discloses a safe wherein the door is wider than the door opening and lies behind the door opening when closed. The door is mounted on a vertical shaft which spans the door opening and reduces the effective opening width of the door. Pins extending from the interior face of the door engage slots in a mount which pivots on the shaft and a crank turned by a handle on the exterior face of the door slides the door on the mount. As the door clears the door opening, it is free to tilt inwards into the safe. The door swings on the mount and gives access to the safe interior. This mechanism reduces access to the safe interior and still requires a conventional bolt system to prevent the door from being forced inwards. The fall weight of the door is carried by the mount. The handle must displace the entire mass of the door sideways in order to clear the door opening.

SUMMARY OF THE INVENTION

This invention provides a security door construction comprising a door and door frame when a door is mounted on an offset hinge and the upright of the frame opposite the hinge has a slot capable of receiving the closing edge of the door, which upon closing slides into the slot and upon opening slides out of the slot.

The slot need only be shallow in that the admission of the margin of the closing edge of the door ensures a large area of engagement between door and frame and a correspondingly large force to displace the door.

The slot may be a 5-12 mm metal door such as is used for a safe. The timber door slot depth may be somewhat greater. The hinge axis is not coincident with the longitudinal edge of the door as in a conventional door. The hinge is offset from the door surface. The throw of the hinge may be 15-25 mm to give the required sliding entry and exit.

When the construction is used in a metal safe, the hinges may be paired conventionally but connected to the door face. The hinges may be connected to the door by a mounting member which provides the offset. The mounting member may be a tube or rod which maintains the hinge axis of the frame hinges parallel to the axis of the door hinges. The invention also provides the feature that the door frame has a frame rail behind the top edge and bottom edges of the rear face of the door, each rail has a slot means and the corresponding area on the rear face of the door have hook means for engaging and disengaging when the door closes and opens.

The top and bottom hinges may be protected by a hinge box fixed to the face of the door.

The door may have a conventional lock with a bolt and a keeper in the door frame. Multiple sliding pin locks may be fitted, but these are not necessary due to the extensive door margin engagement of the slot.

Door and frame construction of this type is particularly applicable to small box safes of the type used to store narcotics, cash and firearms, but is able to support doors on thicker metal safes. One application is now described pertaining to gun safes.

The uprights of the frame may be box-section styles. The door slot may be in the closing style. The body of the safe may be made of a single plate panel which is formed into a channel shape, including the box-section styles braced by a top plate and a bottom plate.

The hinge mounts may be mounted on the floor and the roof of the safe and extended to the safe interior. Each hinge may be part of a flange welded to the floor and roof. The hinges are joined in order to preserve the axis of rotation of the door which would otherwise sag randomly and tilt the plane of the door preventing orderly opening and closing.

The door may be a metal plate connected by a pair of door hinges to a pair of frame hinges. Mounts for the frame hinges are located adjacent the door support style and the gap between the door and style is closed up when the door is locked.

The frame hinges and the door hinges connected thereto are preferably protected by a box extending the full length of the door. The door may be stiffened by a box brace fixed to the interior face of the door. A conventional lock may shoot a bolt into the door closing style.

In some safes and security doors, security could be improved if their operation was made fail safe. The door construction described above may be modified to fail safe by fitting a conventional door closer inside the safe and provision of a thruster which slides the door into the slot. The sliding motion must be delayed until the door is in register with the slot otherwise the door will strike the closing style and never reach the slot. The construction may have a door closer arranged to swing the door shut and a biasing assembly associated with the door capable of sliding the door into the door slot when the door closer brings the door into register with the door slot.

The biasing assembly may impart a sliding motion to the door when the door lands on the closing surface parallel to the plane of the closed door against which the door swings to close before the door reaches the door slot. In such an arrangement, the biasing assembly preferably comprises a door handle with a crank inside the door which reacts against the rod or tube extending between the frame pivots, biasing means acting between the inside of the door and the crank in order to urge the door to slide toward the door slot, a link assembly connected to the crank which restrains the biasing means from imparting such slide motion to the door and a stop extending over at least part of the doors arc of swing which releases the link assembly at the end of the arc when the door registers with the door slot.

BRIEF DESCRIPTION OF THE DRAWINGS

Various embodiments are now described by way of example with reference to the accompanying drawings, in which.

DETAILED DESCRIPTION OF THE PREFERRED EMBODIMENTS

Figure 1:
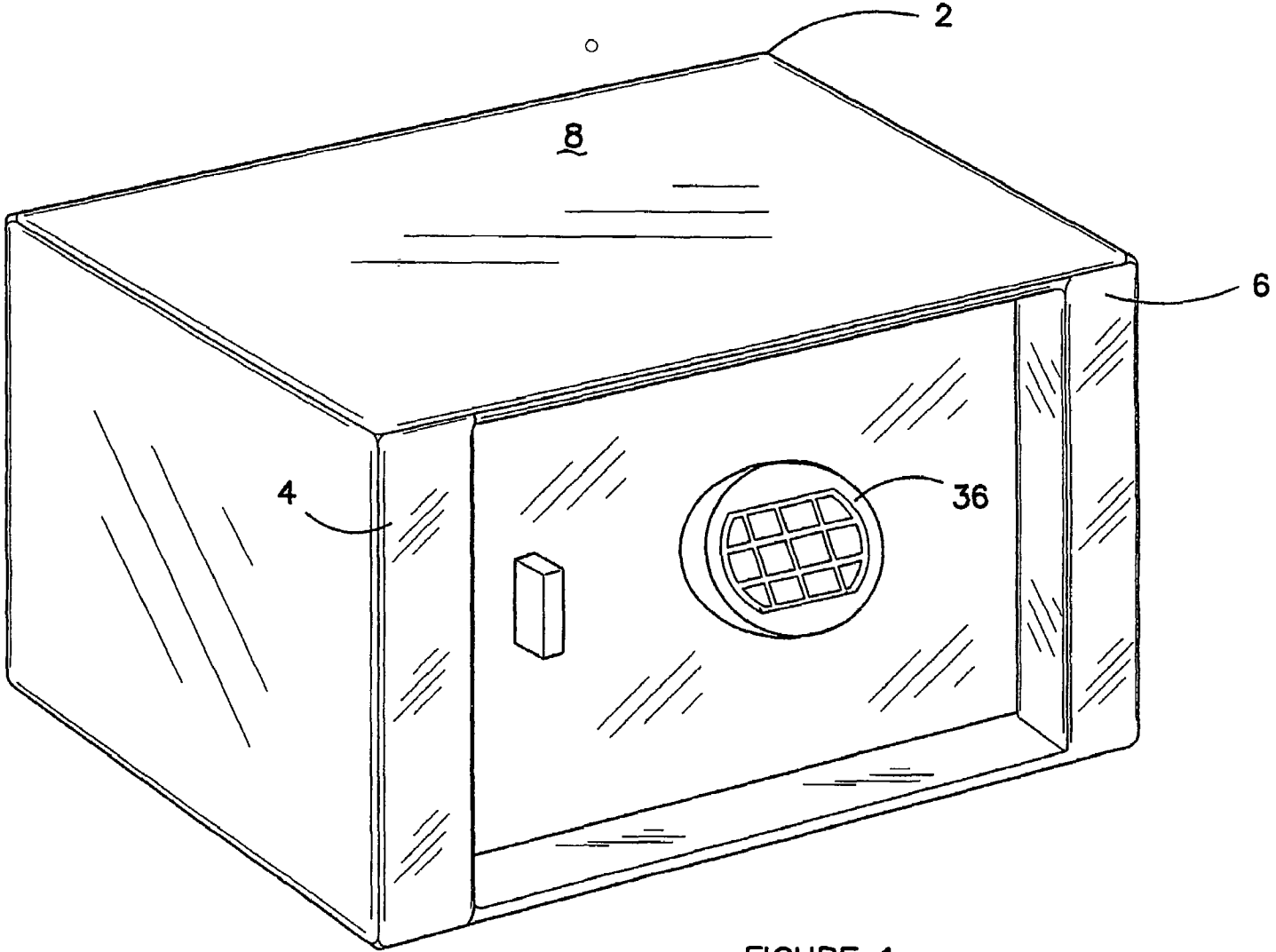
FIG. 1 is a perspective view of a small cash safe with a door closed.

Referring now to the drawings, the safe body 2 is made of 2 mm steel plate which is rolled into a channel section with the edges turned to form further channeled section style assemblies 4, 6. The safe is closed by a top plate 8 and a bottom plate 10 welded to the body. The styles are therefore resistant to being forced apart by a jacking force applied between them.

The channeled section style assembly 4 is composed in part by a closing style 5, which has three sides. The fourth side of channel section style assembly 4 (and 6) is formed by a box section steel closer or upright 12 welded to the body and projecting beyond the closing style 5. The 4 mm gap or slot 14 between the closer 12 and the style 5 extends the full length of the 3 mm steel plate door 16.

Figure 5:
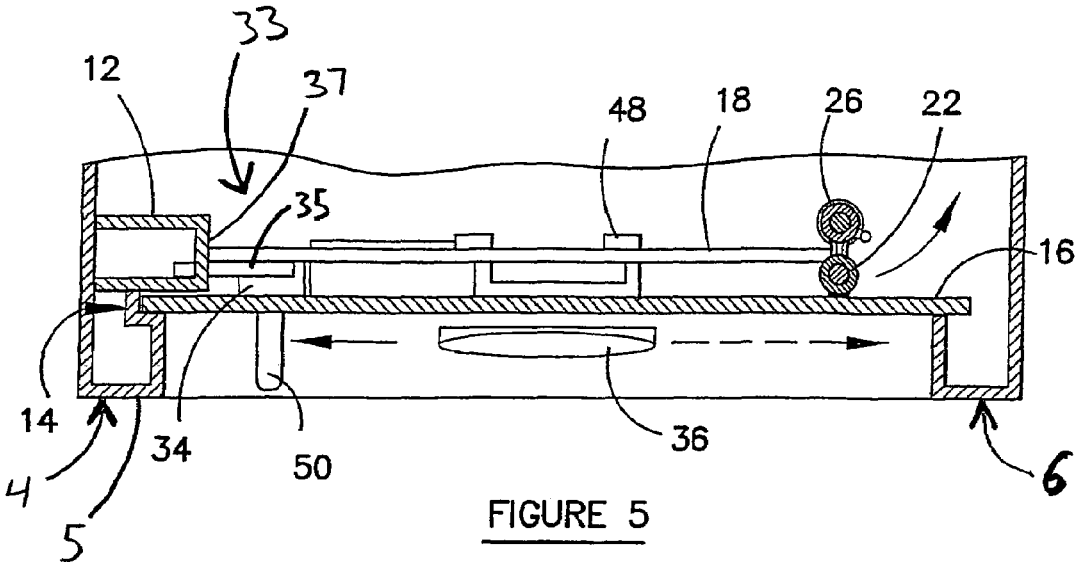
FIG. 5 is a sectional plan of the safe with the door closed.
Figure 6:
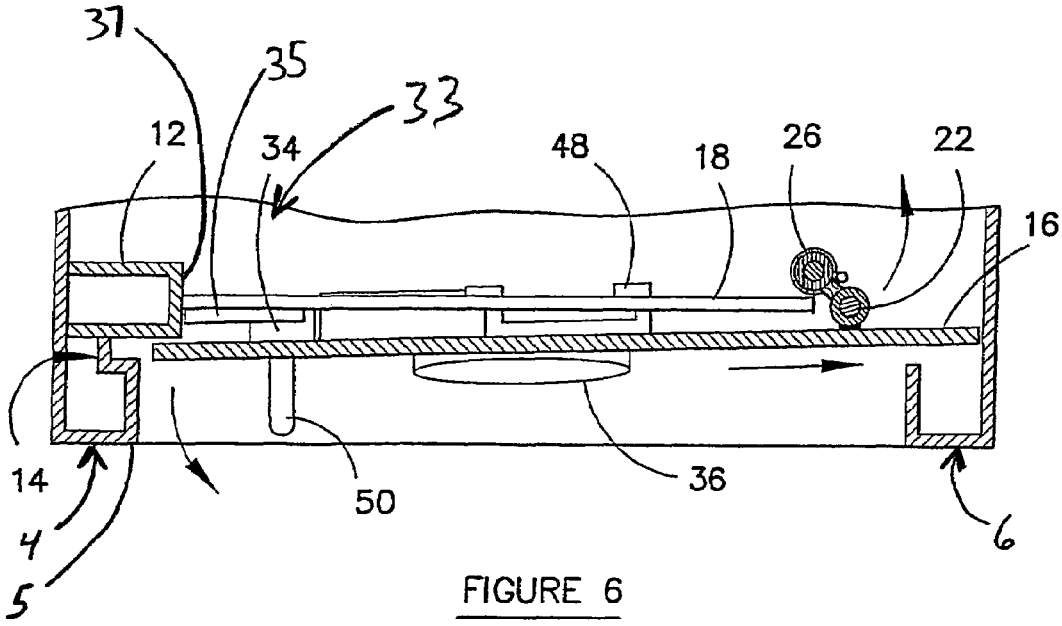
FIG. 6 is a sectional plan of the safe with the door moved sideways.
Figure 7:
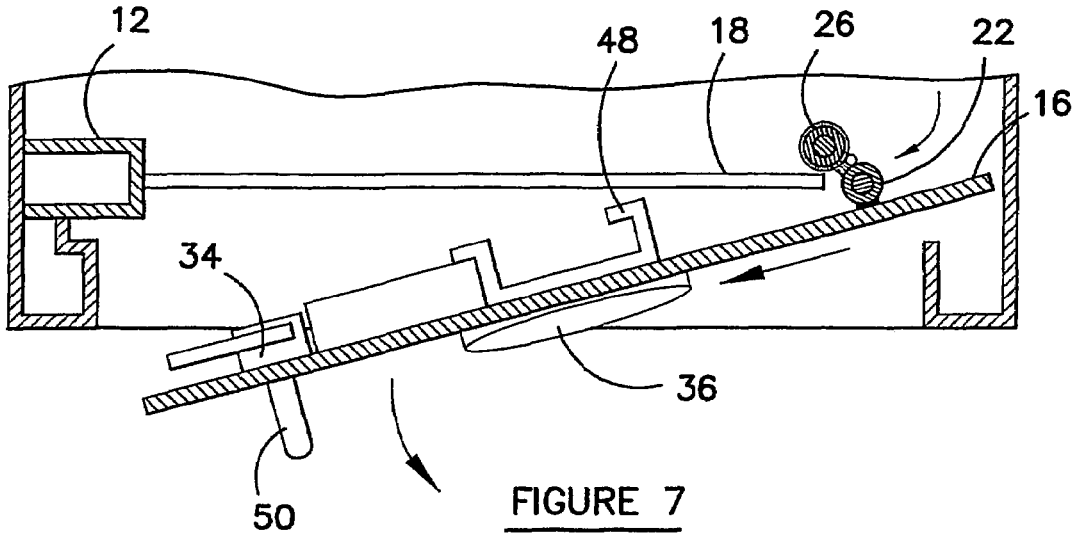
FIG. 7 is a sectional plan of the safe with the door opening.
Figure 8:
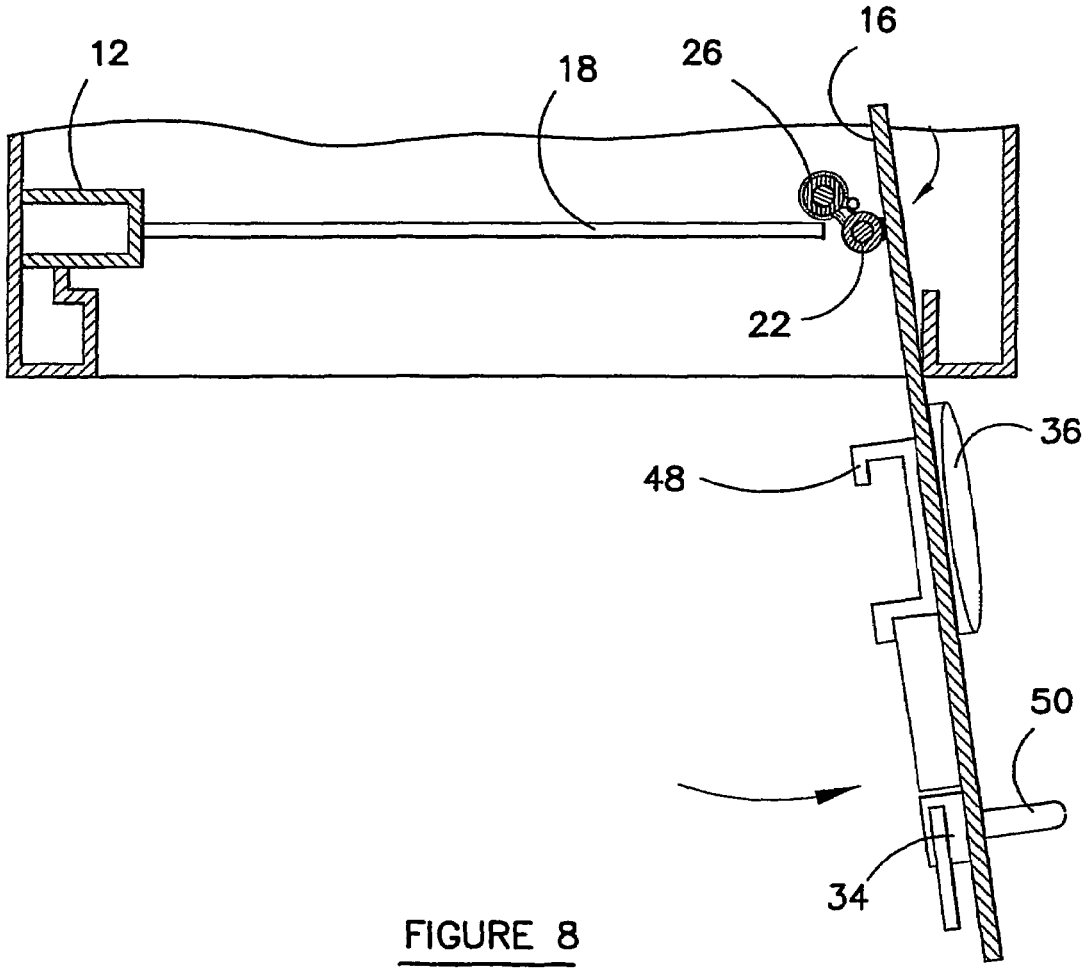
FIG. 8 is a sectional plan of the safe with the door fully open.

A pair of flanges or upstands 18, 20 are inset and welded to the floor and roof. These support a pair of frame hinges 22, 24 which are welded at their ends to the roof and floor. The door 16 tilts on a pair of door hinges 26, 28. The pins of the frame hinges 22, 24 are joined by rod 30. The pins of the door hinges 26, 28 are joined by rod A lock assembly 33 is shown in FIGS. 5 and 6. Lock assembly 33 includes a lock 34, a locking member 35 and a locking structure 37. Lock member 35 is connected to lock 34. Locking structure 37 is part of box action steel closer or upright 12 which is operably connected to locking member 35 when door 16 is in the locked or closed position. FIG. 6 shows locking member 35 in the open or unlocked position where locking structure 37 is not operably connected to locking member 35, while FIG. 5 shows the locked or closed position.

The sequence of opening the door is seen in FIGS. 5, 6, 7 and 8. The joining of rods 30 and 32 produces a throw in the hinge of about 20 mm and the door moves about half of this distance into slot 14. Lock 34 is conventional and is operated by a keypad 36. Without the rigidity of the joined rods 30, 32, the door would sag and resist opening and closing. This rigidity can be achieved variously by other geometries (see FIGS. 14 and 15).

Figure 3:
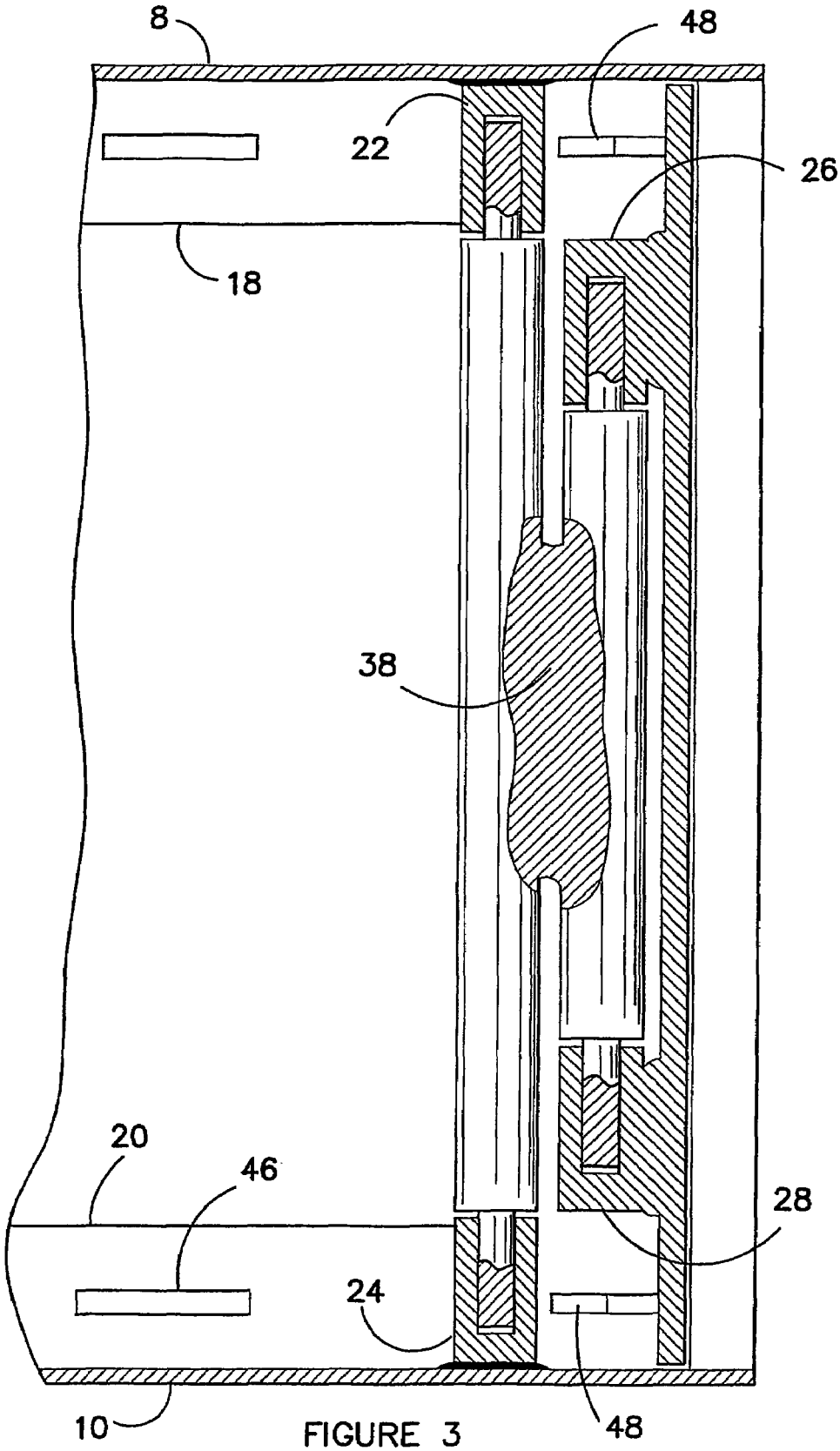
FIG. 3 is a front view of the hinge assembly of FIG. 2 from direction A.
Figure 4:
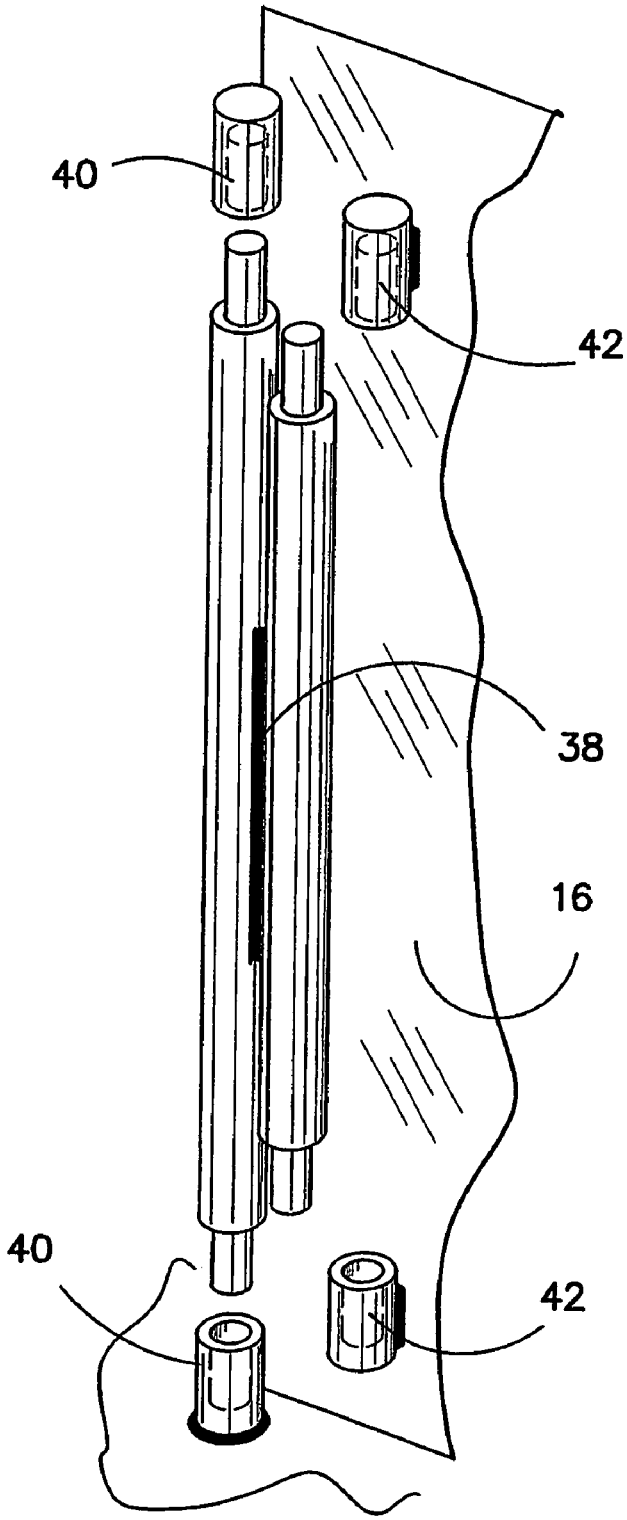
FIG. 4 is an exploded view of the hinge assembly of FIG. 3 after welding.

In FIGS. 3 and 4, the rods 30, 32 are joined or fixed by a common weld 38. In this version, the rods join the pins of the frame hinges 22, 24 to the pins of the door hinges 26, 28. In manufacture, the sequence is as follows.

The body 2 of the safe is rolled to form the edges of the door 16. The top and the floor are welded in position. The rods 30, 32 are welded together in a jig. The hinge collars are added and the hinge assembly is offered up to the door and welded to the door.

The door assembly is then offered up to a jig which also receives the body 2 and then upstands 18, 20 and frame hinges 22, 24 are welded to the body 2. Hinge pockets 40 abut the upstands 18, 20 and are welded to the roof and floor. The door assembly is offered up to the safe opening and pockets 42 abut the upstands 18, 20 and are welded to the roof and floor.

Upstands 18 and 20 have slots 46 for the reception of a pair of hooks 48 extending from door 16 which engage and disengage the slots 46 as the door 16 opens and closes. The hook and slot engagement is in addition to the conventional lock.

Figure 9:
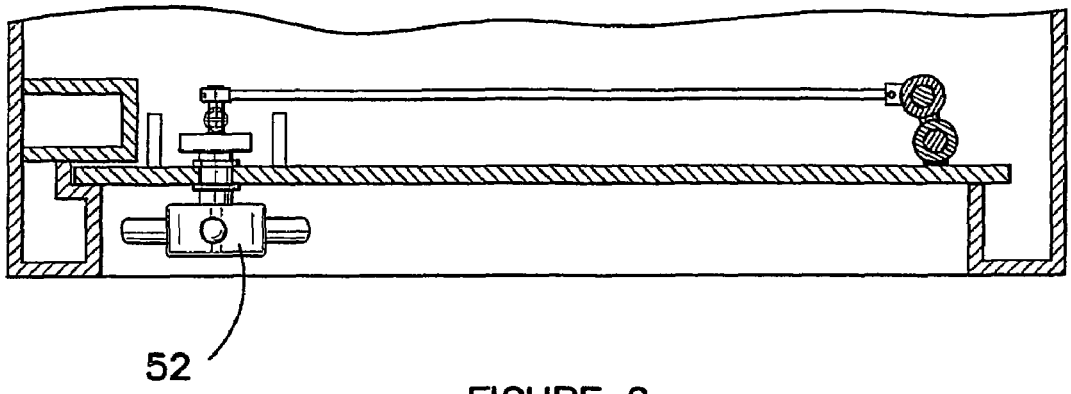
FIG. 9 is a sectional plan of the safe door with the handle for opening and closing the door.
Figure 10:
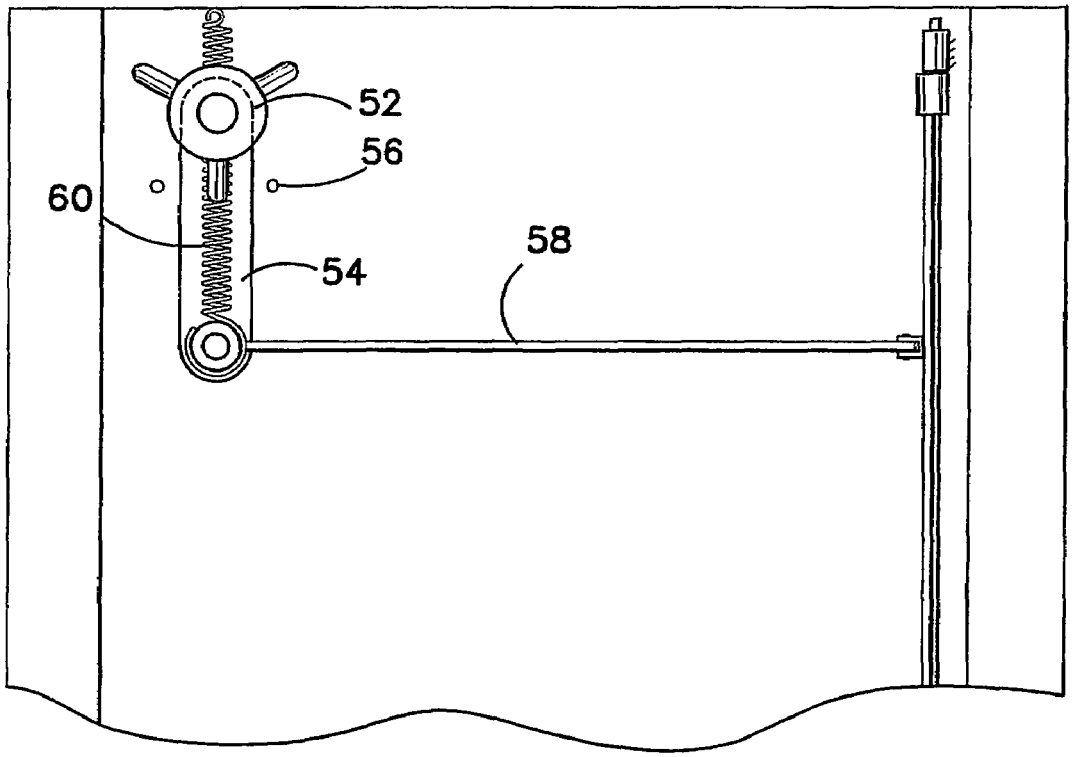
FIG. 10 is a front view of a fragment of the safe showing the handle linkage to the hinge assembly.

The sliding motion of the door is initiated by the person opening the safe, usually by exerting pressure on a D-handle 50 (FIGS. 5-8). As clearly shown in original FIGS. 5 and 6, the pressure or lateral force exerted by a person is shown as a solid arrow pointing at D-handle 50 which will move door 16 into a locked or closed position. In FIG. 6, a solid arrow pointing away from D-handle 50 describes the pressure or lateral force to move door 16 into an unlocked or open position. During this movement, door hinge 22 rotates in a counterclockwise direction as shown by a curved arrow in FIG. 6. Similarly, door hinge 22 rotates in clockwise direction during the locking movement in FIG. 5. In FIG. 9, a handwheel 52 mounted on door 16 turns a crank 54 between stops 56 and a link 58 reacts against rod 30 causing the door 16 to slide easily to LEFT or RIGHT. A spring 60 overcomes resistance to initial movement.

Figure 11:
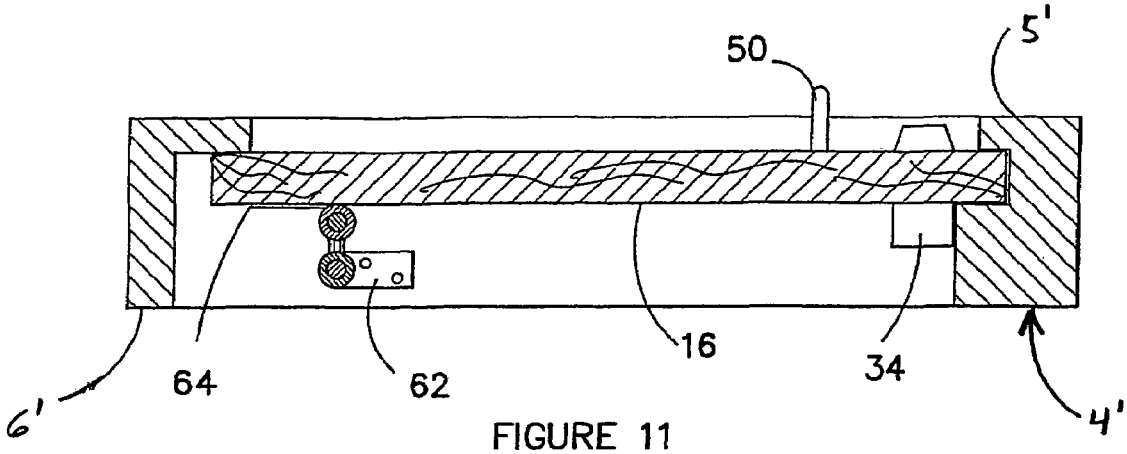
FIG. 11 is a sectional plan of a timber door and casing with the door closed.
Figure 12:
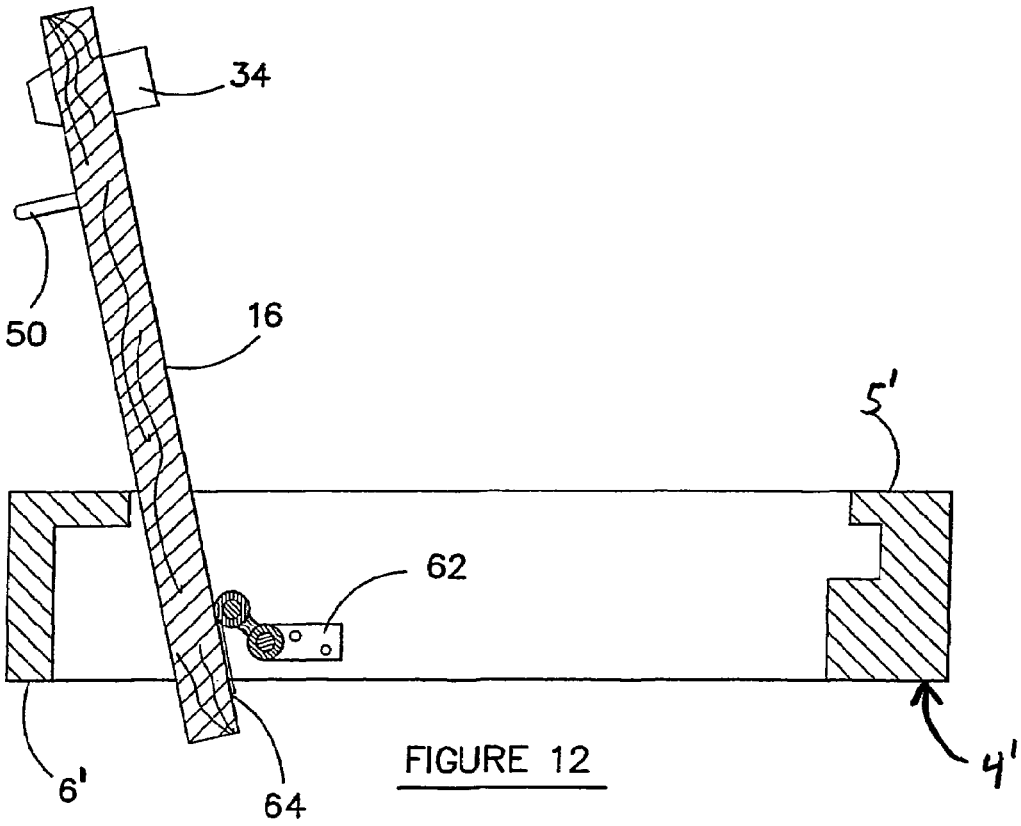
FIG. 12 is a sectional plan of the door and casing of FIG. 11 with the door open.

In FIGS. 11 and 12, the upstands are not used because a timber security door has a closing style 5' forming a part of a channeled section style 4' and an L-section support style 6'. Frame hinges 22, 24 are secured to the door casing by end plates 62 and the door hinges 26, 28 are screwed to the door by hinge leaves 64. Handle 50 and lock 34 are conventional.

Figure 13:
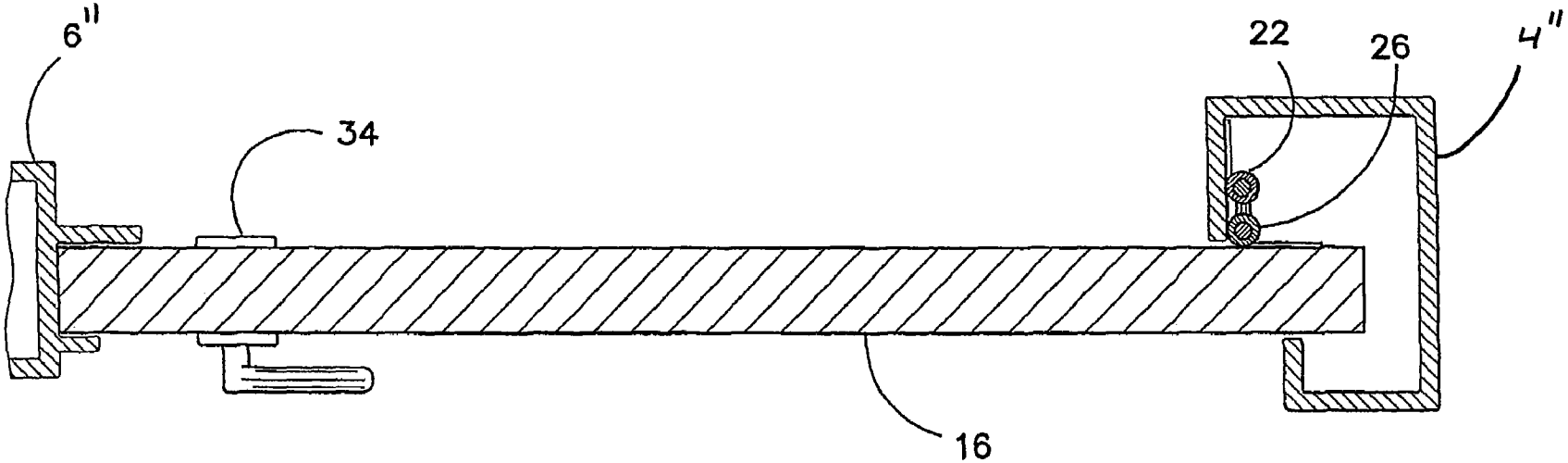
FIG. 13 is a sectional plan of an aluminum security door with the door closed.

In FIG. 13, the frame hinges 22, 24 (one shown) and door hinges 26, 28 (one shown) have hinge leaves 64 which are all accommodated inside support stud or closing style 4". Support stud 4" and closing stud or section style 6" are hollow aluminum extrusions. Lock 34 has diverging hooks which open out inside hollow stud 6.

Figure 14:
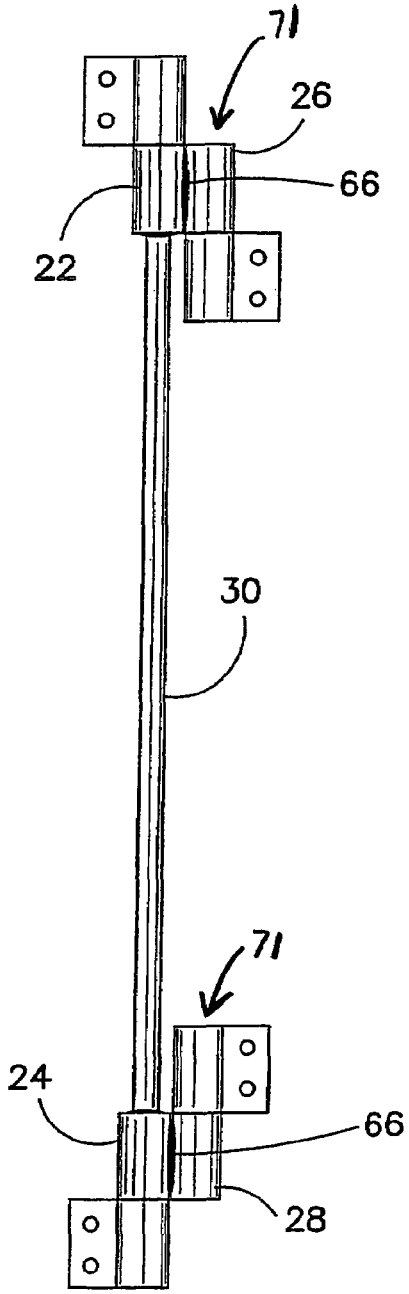
FIG. 14 is a front view of a hinge assembly for the door of FIG. 13 which is also supplied as a separate component for a suitable door and casing.

The aluminum security door shown in FIG. 13 has a hinge assembly 71 which may be sold separately and this is shown in FIG. 14. Rod 30 joins the pockets of frame hinges 22, 24 so they tilt in unison. The pockets of the hinges 22, 24 are joined to the pockets of the door hinges 26, 28 by welds 66.

Figure 15:
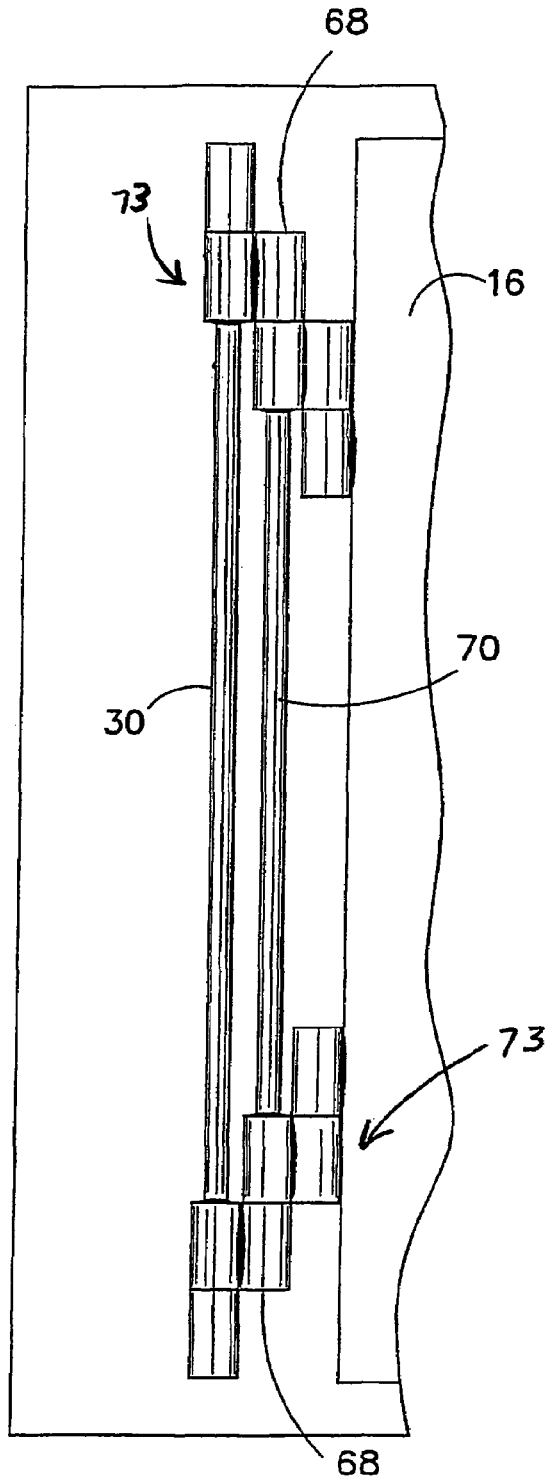
FIG. 15 is a front view of a triple hinge layout.

In FIG. 15, the throw of the hinge assembly is increased by using triple hinges 73 welded together as sets. The door is prevented from sagging by joining the door hinges to the door and the frame hinges by rod 30 and the intermediate hinges 68 by intermediate rod 70.

Figure 2:
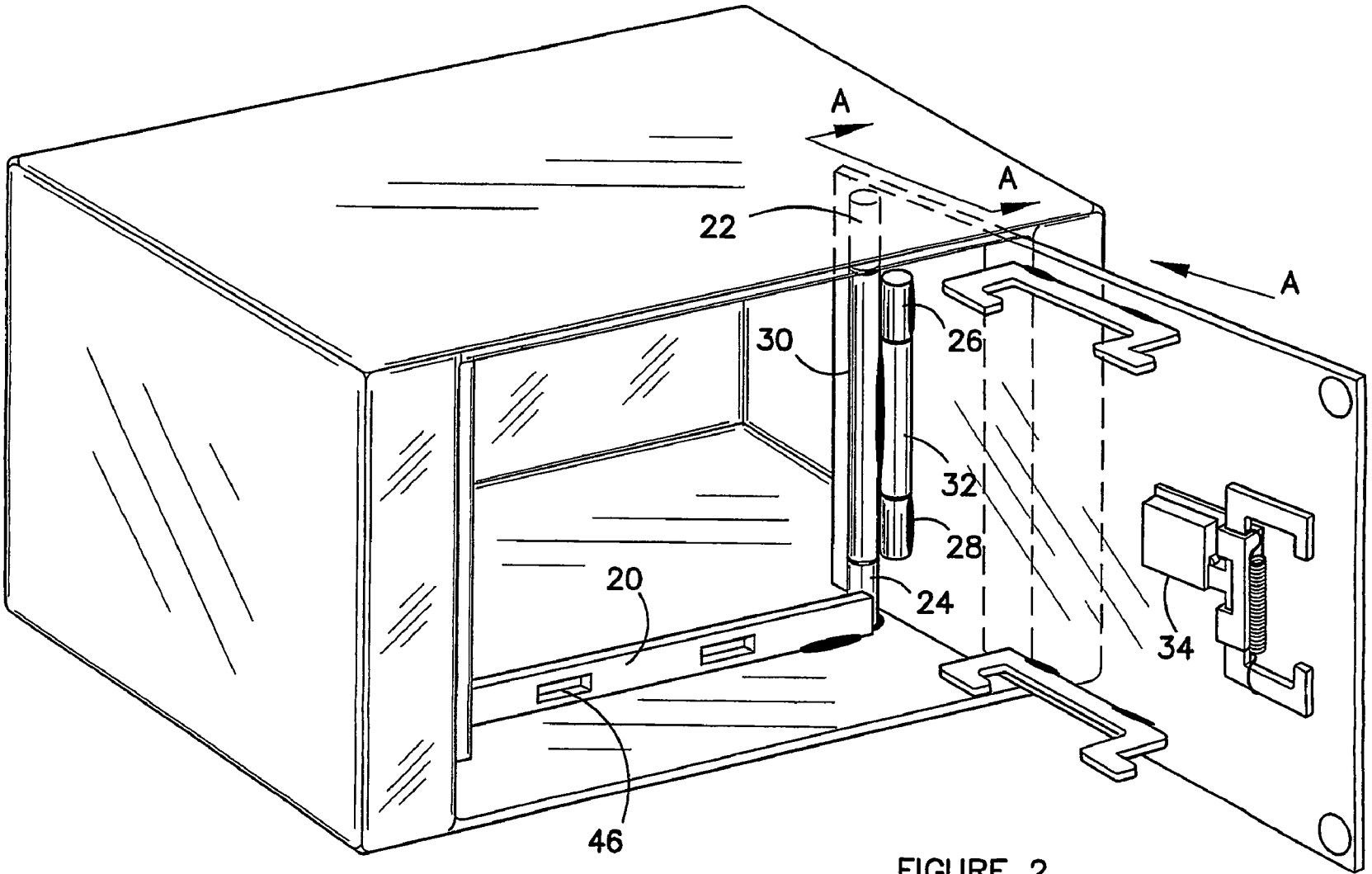
FIG. 2 is a perspective view of a safe of FIG. 1 with the door open.
Figure 16:
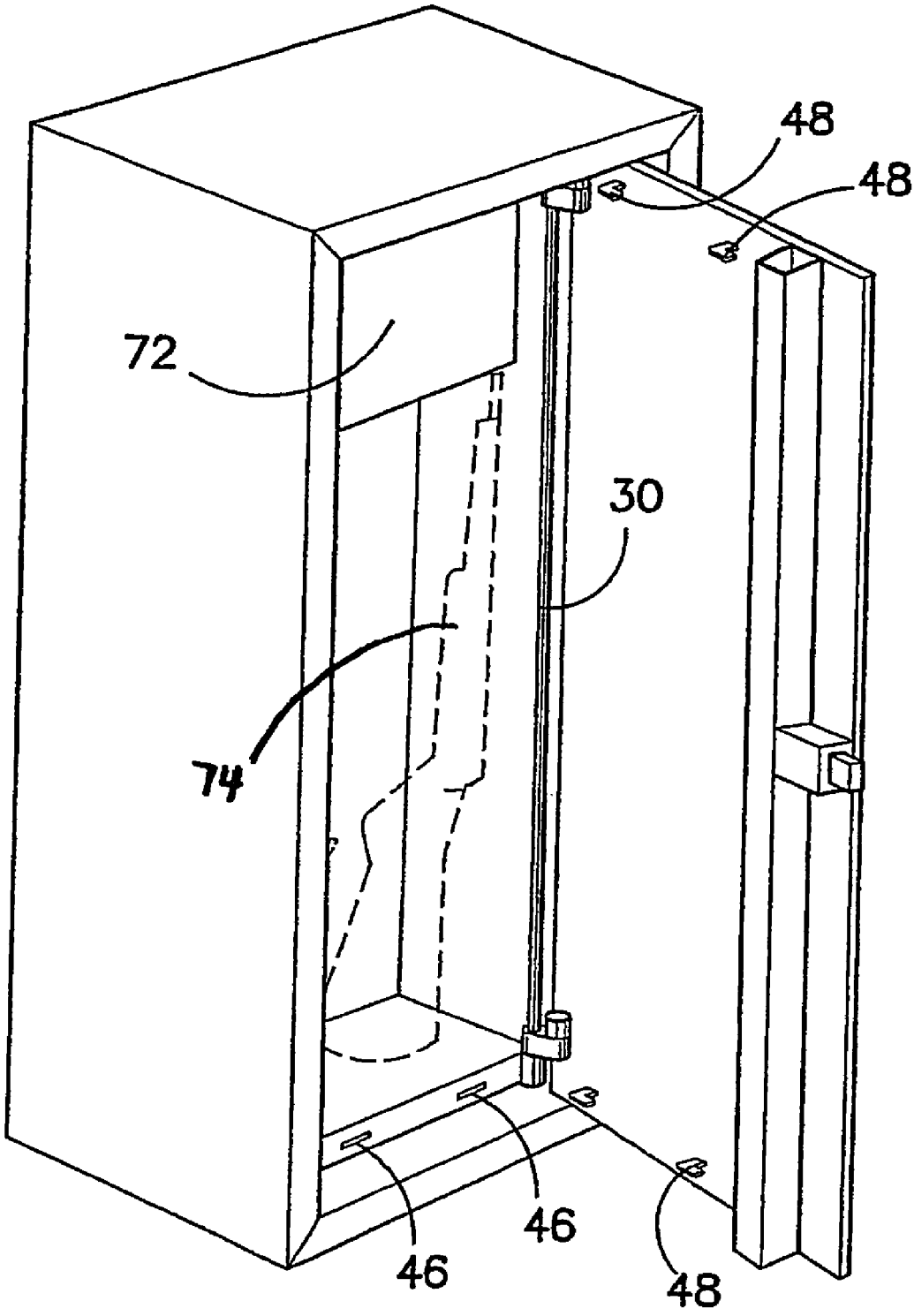
FIG. 16 is a diagrammatic perspective view of a gun safe showing the hinge assembly.

In a gun safe shown in FIG. 16, the pockets of the frame hinges 22, 24 are connected to the pins of the door hinges 26, 28. The hooks 48 and slots 46 engage and disengage as in the embodiment shown in FIGS. 2 and 3. An ammunition box 72 leaves space for a weapon 74.

Figure 17:
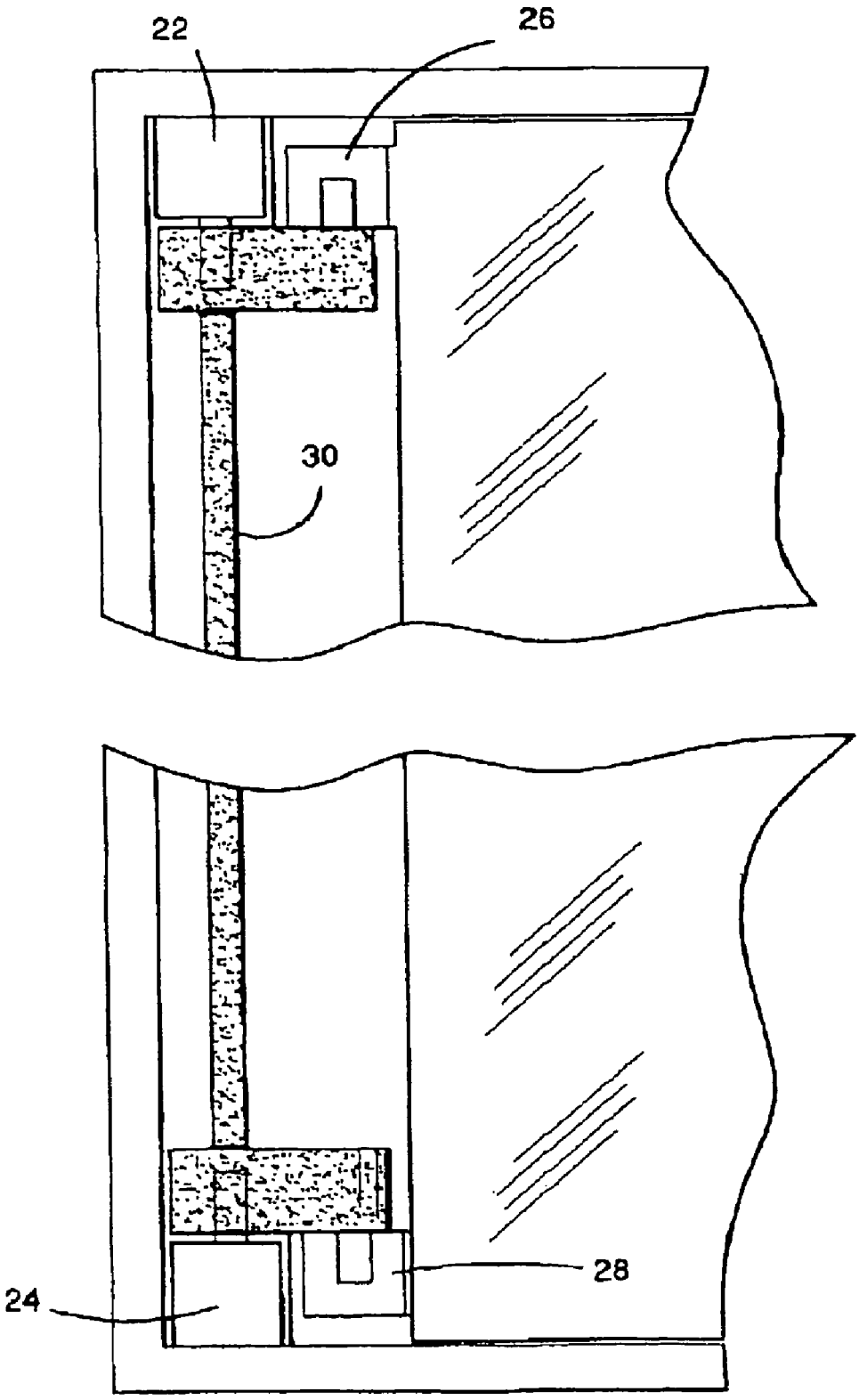
FIG. 17 is a front sectional view of the hinge of FIG. 16.

FIG. 17 assists in understanding the offset motion of the door. The components which are stippled lie in one plane and behave as a unitary part in the hinge assembly in the manner of a radius arm.

Figure 18:
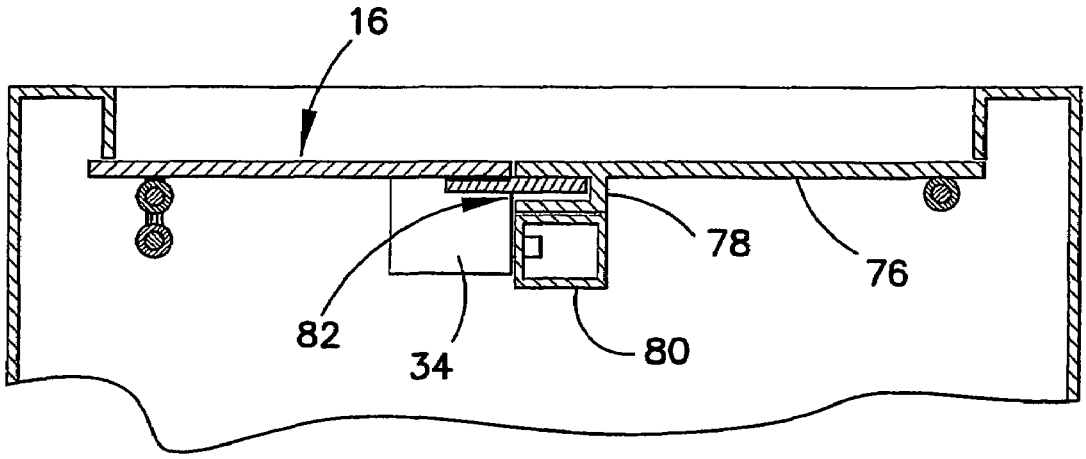
FIG. 18 is a sectional plan of a two door safe with a central pillar.

When a walk-in safe is constructed as for a cigarette and alcohol store, gunrooms, armories and the like, a conventional door 76 (FIG. 18) has a longitudinal pocket 78 at the closing edge which closes to the central pillar 80 and defines a slot 82 into which the sliding door 16 projects in order to allow lock 34 to operate.

Figure 19:
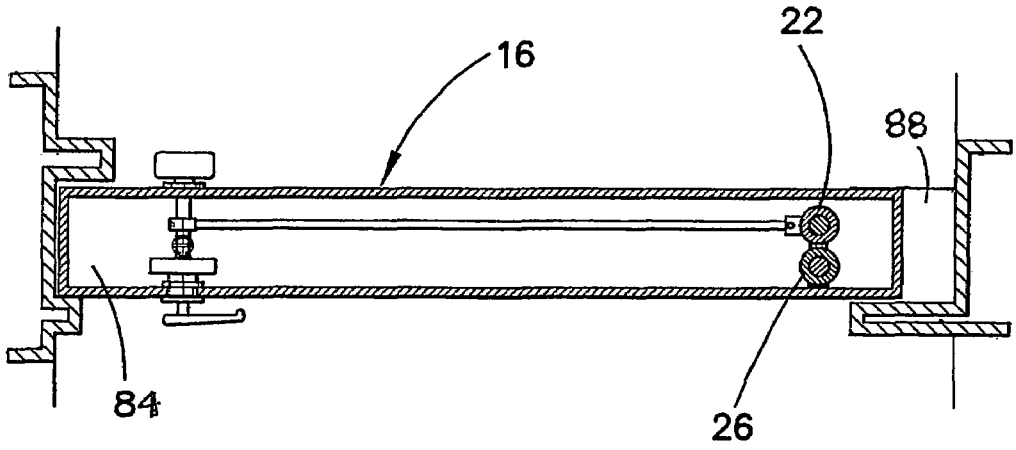
FIG. 19 is a plan view of a steel plate door.
Figure 20:
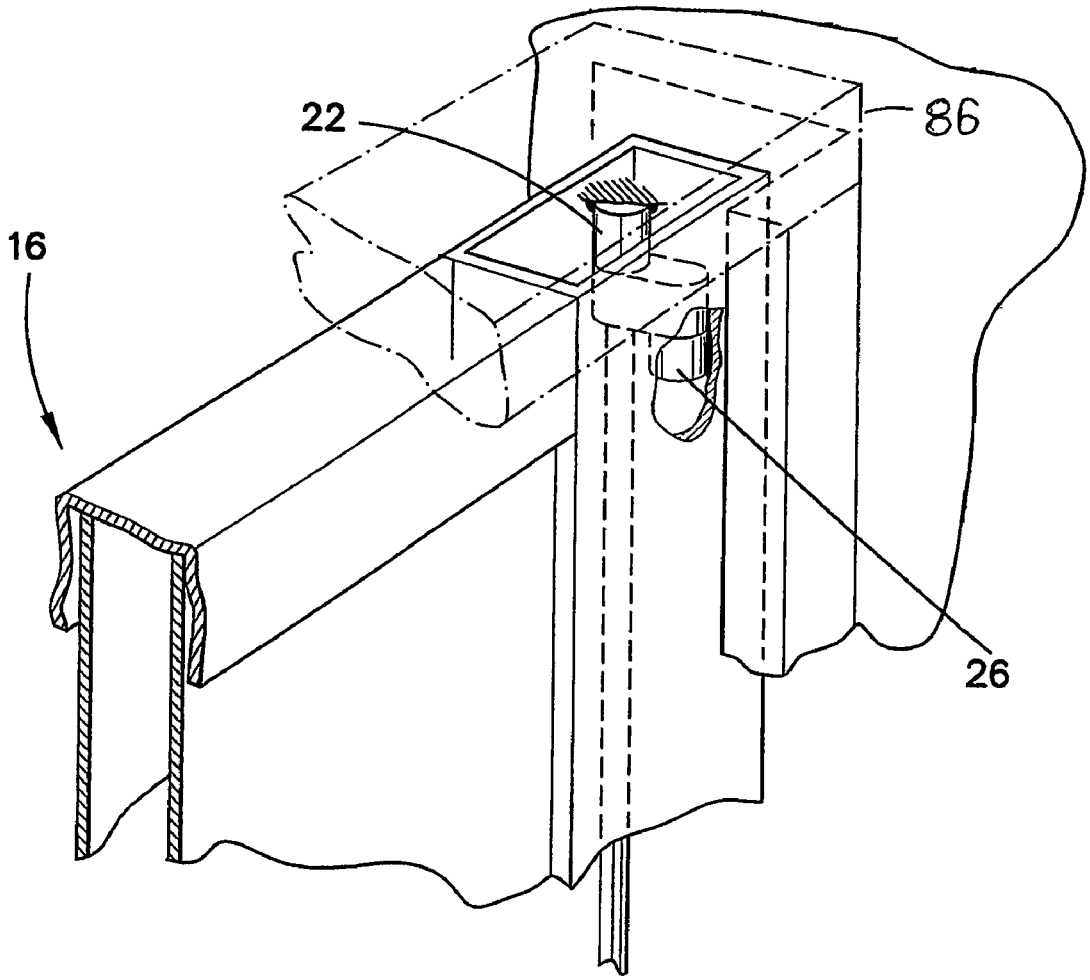
FIG. 20 is a perspective partly sectioned view of the upper part of the door shown in FIG. 19.
Figure 21:
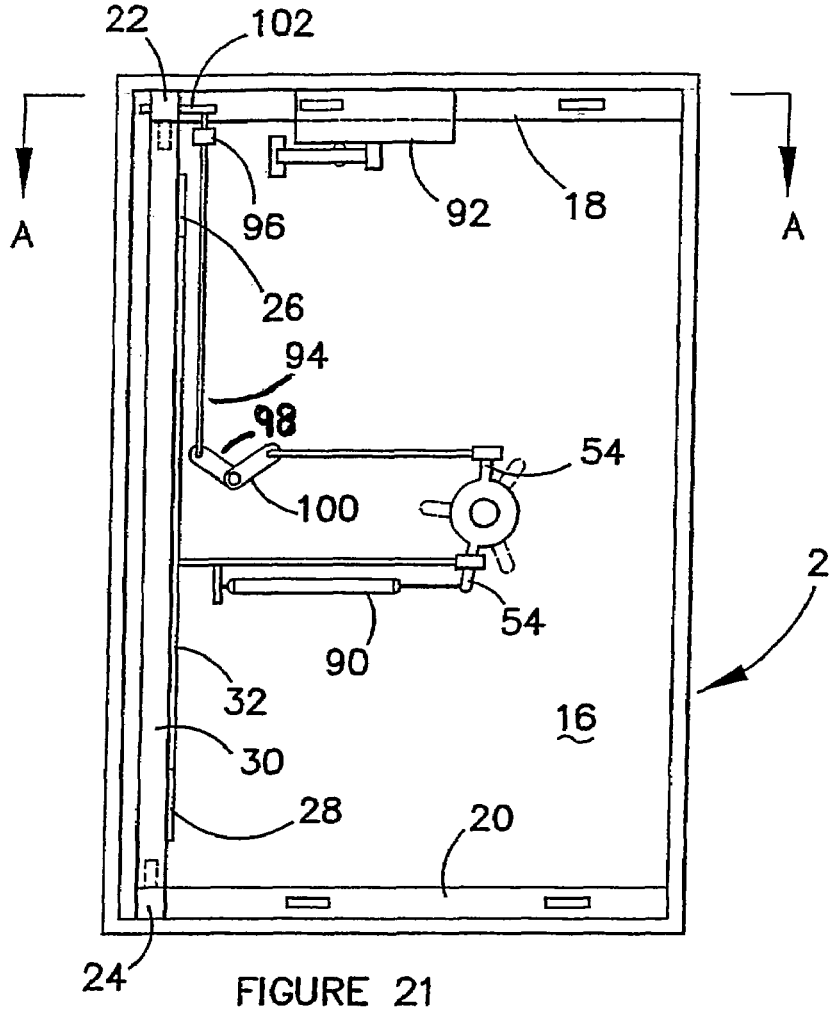
FIG. 21 is a rear view of a safe containing the mechanism looking through the safe with the back removed.
Figure 22:
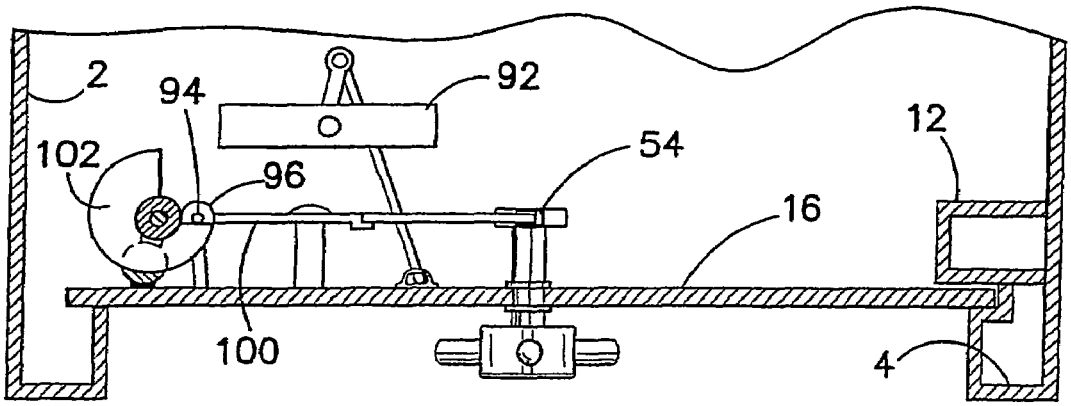
FIG. 22 is a plan of the safe of FIG. 1 looking from Direction A.

In FIGS. 19 and 20, steel plate door 16 has a hollow interior 84. The hinge assembly is housed in the interior, the door hinge 26 being welded to the inside of the door and the frame hinge 22 being welded to the door frame header 86 and the floor bar 88.

Door handle 52 connects to crank 54 and link 58 reacts against rod 30 causing the door to slide easily LEFT or RIGHT. Crank 54 is also acted upon by gas strut 90 which tends to move the door to the RIGHT thereby pushing the door into the door slot. A conventional door closer 92 is mounted inside the safe on the roof as shown.

The cranks movement in response to the force of the gas strut is resisted by a rod 94 which rises and falls in collar 96 under the influence of rigid connector 98 and bell crank 100. Rod 94 describes an arc when the door 16 opens and is prevented from rising and imparting the force of the gas strut to the door by contact with the underside of arcuate stop 102. The stop is stationary and extends from frame hinge 22. When the door closer swings the door closed and the door lands on the closing surface of style 4, rod 94 reaches the end of the stop and suddenly rises under the force of the gas strut. The handle is subjected to a force sliding the door to the RIGHT and is free to move on the hinge assembly because the latter has an offset configuration.

When closed, the end of rod 94 projects above the arcuate stop 102. Turning the handle pulls rod 94 under the stop and swinging the door open against the closer retains the rod 94 under the stop. When the handle is released, the door closer swings the door shut but the sliding motion is delayed until the door registers with the slot.

In another version, the gas strut drives a pair of bolts into keepers in the closer 12.

We have found the advantages of the above embodiment to be:

1. The usual sites for the prying bar are absent in the construction.

2. No multiple entry bolts are necessary.

3. Doors of considerable mass are easily moved.

4. The fall width of the door is available.

It is to be understood that the word "comprising" as used throughout the specification is to be interpreted in its inclusive form, i.e. use of the word "comprising" does not exclude the addition of other elements.

It is to be understood that various modifications of and/or additions to the invention can be made without departing from the basic nature of the invention. These modifications and/or additions are therefore considered to fall within the scope of the invention.

The invention claimed is:

1. A security door construction having opposing side portions and comprising:

a door having a top and a bottom, an inside and an outside, a closing edge and being slidably movable in a slide motion between an open position and a closed position;

a door frame having a top and bottom;

at least one hook located on the inside of said door;

at least one hook slot located on said door frame for receiving said at least one hook located on the inside of said door; and an offset hinge assembly on one side portion of said security door construction, said offset hinge assembly comprising:

a first top door frame hinge;

a first bottom door frame hinge having a common first axis with said first top door frame hinge;

a first top pin disposed in said first top door frame hinge;

a first bottom pin disposed in said first bottom door frame hinge;

a first rigid member connected to said first top pin and said first bottom pin;

a second top door hinge;

a second bottom door hinge having a common second axis with said second top door hinge;

a second top pin disposed in said second top door hinge;

a second bottom pin disposed in said second bottom door hinge;

a second rigid member connected to said second top pin and said second bottom pin;

said first and second axes being parallel, and said first and second rigid members being fixed relative to each other;

a locking structure fixed on said door frame;

a locking assembly mounted on said door, said locking assembly having a movable locking member having a locking condition for releasably engaging said locking structure and an unlocking condition wherein said locking assembly is released from said locking structure, and a locking handle moving said locking member between the locking condition and the unlocking condition;

wherein said door frame comprises a closing style, an upright against which said door closes, said upright being located on the opposite side portion of said security door construction from said offset hinge assembly, and wherein a door slot is located between said closing style and said upright for slidingly receiving the closing edge of said door when said door moves into the closed position and for slidingly releasing the closing edge of said door when said door moves to the open position, wherein said locking handle is operable upon receiving a lateral force, to effect a throw of said hinge assembly to cause the sliding movement of said door to selectively move said door from the open position to the closed position and to move said locking member from the unlocking condition to the locking condition, or move said door from the closed position to the open position and move said locking member from the locking condition to the unlocking condition.

2. A security door construction as claimed in claim 1, wherein the first and second rigid members are rods.

3. A security door construction as claimed in claim 1, and further comprising:

a first upstand fixed to the top of said door frame; and a second upstand fixed to the bottom of said door frame, wherein said top door frame hinge has a top end and said bottom door frame hinge has a bottom end, the top end of said top door frame hinge being fixed to the top of said door frame and to said first upstand, and the bottom end of said bottom door frame hinge being fixed to the bottom of the door frame and said second upstand.

4. A security door construction as claimed in claim 1, wherein said upright of said door frame is a box section steel closer.

5. A security door construction as claimed in claim 1, wherein the slide motion is 15-25 mm.

6. A security door construction as claimed in claim 1, wherein the door is substantially planar and the door frame has a closing surface parallel to the plane of the closed door against which the door tilts to close before the door reaches the door slot.

7. A security door construction as claimed in claim 1, wherein said first and second rigid members are welded to each other.

8. A security door construction as claimed in claim 3, wherein said first upstand is welded to the top of said door frame and said second upstand is welded to the bottom of said door frame.

9. A security door construction as claimed in claim 3, wherein said top end of said top door frame hinge is welded to the top of said door frame and to said first upstand, and the bottom end of said bottom door frame hinge is welded to the bottom of said door frame and said second upstand.

10. A security door construction having opposing side portions and comprising: a door having a top and a bottom, an inside and an outside, a closing edge and being slidably movable in a slide motion between an open position and a closed position;

a door frame having a top and bottom;

at least one hook located on the inside of said door;

at least one hook slot located on said door frame for receiving said at least one hook located on the inside of said door; and an offset hinge assembly on one side portion of said security door construction, said offset hinge assembly comprising:

a first top door frame hinge;

a first bottom door frame hinge having a common first axis with said first top door frame hinge;

a first top pin disposed in said first top door frame hinge;

a first bottom pin disposed in said first bottom door frame hinge;

at least one first rigid member connected to said first top pin and said first bottom pin;

a second top door hinge;

a second bottom door hinge having a common second axis with said second top door hinge;

a second top pin disposed in said second top door hinge;

a second bottom pin disposed in said second bottom door hinge;

a second rigid member connected to said second top pin and said second bottom pin;

said first and second axes being parallel, and said first and second rigid members being fixed relative to each other;

a locking structure fixed on said door frame;

a locking assembly mounted on said door, said locking assembly having a movable locking member having a locking condition for releasably engaging said locking structure and an unlocking condition wherein said locking assembly is released from said locking structure, and a locking handle moving said locking member between the locking condition and the unlocking condition;

wherein said door frame comprises a closing style, an upright against which said door closes, said upright being located on the opposite side portion of said security door construction from said offset hinge assembly, and wherein a door slot is located between said closing style and said upright for slidingly receiving the closing edge of said door when said door moves into the closed position and for slidingly releasing the closing edge of said door when said door moves to the open position, wherein said locking handle is operable upon receiving a lateral force, to effect a throw of said hinge assembly to cause the sliding movement of said door to selectively move said door from the open position to the closed position and to move said locking member from the unlocking condition to the locking condition, or move said door from the closed position to the open position and move said locking member from the locking condition to the unlocking condition.

11. A safe comprising:

a body, wherein said body is made of a single plate panel which is formed into a channel section including styles braced by a top plate and a bottom plate; and a security door construction having opposing side portions and comprising:

a door having a top and a bottom, an inside and an outside, a closing edge and being slidably movable in a slide motion between an open position and a closed position;

a door frame having a top and bottom;

at least one hook located on the inside of said door;

at least one hook slot located on said door frame for receiving said at least one hook located on the inside of said door; and an offset hinge assembly on one side portion of said security door construction, said offset hinge assembly comprising:

a first top door frame hinge;

a first bottom door frame hinge having a common first axis with said first top door frame hinge;

a first top pin disposed in said first top door frame hinge;

a first bottom pin disposed in said first bottom door frame hinge;

a first rigid member connected to said first top pin and said first bottom pin;

a second top door hinge;

a second bottom door hinge having a common second axis with said second top door hinge;

a second top pin disposed in said second top door hinge;

a second bottom pin disposed in said second bottom door hinge;

a second rigid member connected to said second top pin and said second bottom pin;

said first and second axes being parallel, and said first and second rigid members being fixed relative to each other;

a locking structure fixed on said door frame;

a locking assembly mounted on said door, said locking assembly having a movable locking member having a locking condition for releasably engaging said locking structure and an unlocking condition wherein said locking assembly is released from said locking structure, and a locking handle moving said locking member between the locking condition and the unlocking condition;

wherein said door frame comprises a closing style, an upright against which said door closes, said upright being located on the opposite side portion of said security door construction from said offset hinge assembly, and wherein a door slot is located between said closing style and said upright for slidingly receiving the closing edge of said door when said door moves into the closed position and for slidingly releasing the closing edge of said door when said door moves to the open position, wherein said locking handle is operable upon receiving a lateral force, to effect a throw of said hinge assembly to cause the sliding movement of said door to selectively move said door from the open position to the closed position and to move said locking member from the unlocking condition to the locking condition, or move said door from the closed position to the open position and move said locking member from the locking condition to the unlocking condition.

* * * * *